US006322185B1

(12) United States Patent
Asano et al.

(10) Patent No.: US 6,322,185 B1
(45) Date of Patent: Nov. 27, 2001

(54) INKJET PRINTING DEVICE

(75) Inventors: Masaki Asano, Nishinomiya; Shoichi Minato, Sakai, both of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/036,561

(22) Filed: Mar. 9, 1998

(30) Foreign Application Priority Data

Mar. 13, 1997 (JP) ..... 9-059262

(51) Int. Cl.[7] ..... B41J 2/205
(52) U.S. Cl. ..... 347/15
(58) Field of Search ..... 347/15, 5, 24, 347/10, 9, 37, 43, 14, 47, 11, 19

(56) References Cited

U.S. PATENT DOCUMENTS 4,635,078 * 1/1987 Sakurada et al. ..... 347/15
5,369,428 * 11/1994 Maze et al. ..... 347/5
5,610,637 * 3/1997 Sekiya et al. ..... 347/10
5,729,257 * 3/1998 Sekiya et al. ..... 347/9
5,992,972 * 11/1999 Nagoshi et al. ..... 347/43

OTHER PUBLICATIONS

Electrographic Society, *Imaging Part 2*, "DOD Printer (1)" of Section 3 (pp. 134–135), published Jul. 20, 1988.
Electrographic Society, *Imaging Part 3*, "InkJet Recording Head" of Section 3 (p. 41), published Dec. 20, 1988.

* cited by examiner

*Primary Examiner*—John Barlow
*Assistant Examiner*—Charles W. Stewart Jr.
(74) *Attorney, Agent, or Firm*—Sidley & Austin

(57) ABSTRACT

An inkjet printing apparatus having a print head and a control system to control the discharge of variable size ink drops from the print head. The control system controls a print operation to divide the printing of an image into steps, wherein at least a first step includes the printing of dots having diameters within a specified range and at least a second step includes the printing of dots having diameters within another specified range.

21 Claims, 9 Drawing Sheets

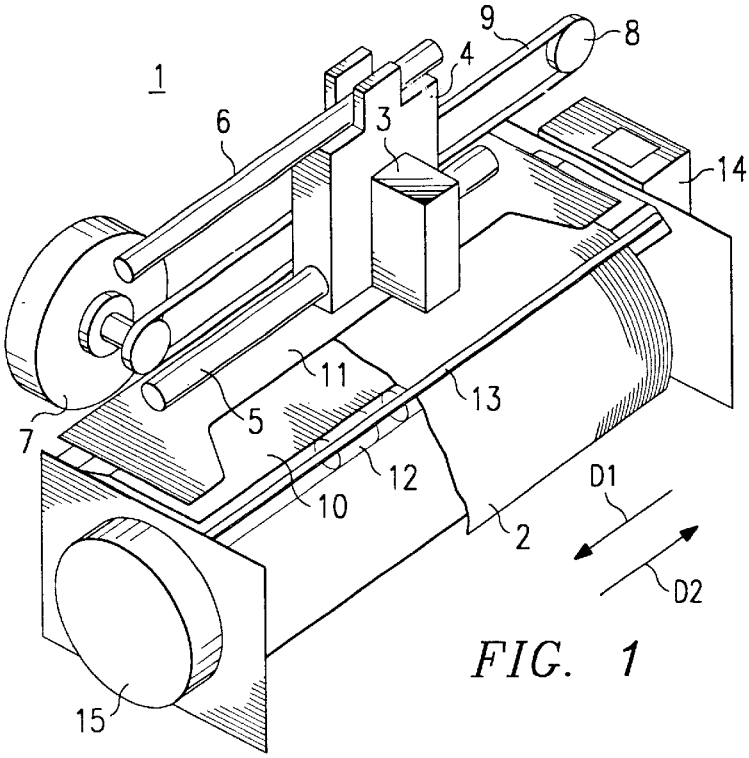
FIG. 1
FIG. 2
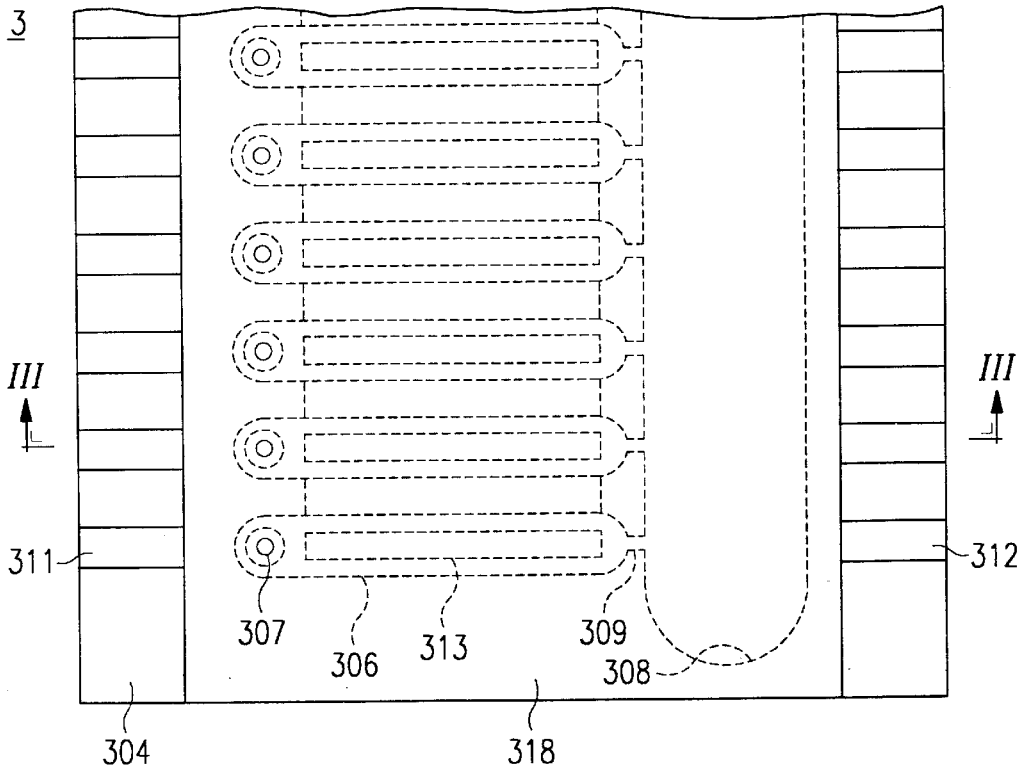

INKJET PRINTING DEVICE

BACKGROUND OF THE INVENTION

Conventionally, there are known inkjet printers having print heads provided with a piezoelectric element (PZT). For such print heads, a pulse voltage corresponding to image information is applied to the piezoelectric element, causing a predetermined distortion of the piezoelectric element. This distortion pressurizes ink inside an adjacent container, or ink channel, and an ink drop is discharged from the ink channel toward a print sheet, thus forming a printed ink dot. A plurality of printed ink dots yields an image on the print sheet.

A printer of this type also creates image gradations by discharging ink drops of different diameters. Different diameter ink drops are achieved by varying the amount of change (degree of distortion) of the piezoelectric elements. Specifically, by reducing the amount of change in the piezoelectric element, an ink drop of a smaller diameter is discharged, and by increasing the amount of change in the piezoelectric element, an ink drop of a larger diameter is discharged.

Interestingly, as the amount of change in the piezoelectric element increases, the speed of discharge of a corresponding ink drop from the print head increases. Therefore, ink drops of different diameters have different travel speeds. Conventionally, piezoelectric elements are driven in constant cycles, regardless of the size of the ink drops to be expelled. As an example of the issues created by this arrangement, where the discharge of ink drops of a large diameter follow the discharge of small diameter ink drops, the distance between the centers of printed dots having small diameters and the printed dots having large diameters is smaller than the distance which is ordinarily obtained. In this way, a shift occurs in the positions of the printed dots due to the difference in the travel speeds of the discharged ink drops. This shift causes a marked deterioration in image quality.

FIGS. 19 through 21 illustrate the deterioration in image quality due to a shift in dot position caused by differing ink drop travel speeds following discharge.

FIGS. 19(*a*) and 19(*b*) illustrate the deterioration in image quality due to a shift in dot position in a printer using the dither method. FIG. 19(*a*) shows a standard dither method, while FIG. 19(*b*) shows gradations using the dither method when a shift in dot position has occurred. The numbers in FIGS. 19(*a*) and 19(*b*) represent a gradation number. Arrow D3 (FIG. 19(*a*)) represents the direction of scanning of a print head.

Assuming the travel speeds of a large diameter ink drop and a small diameter ink drop are equal, the dot pattern is printed as shown in FIG. 19(*a*). However, as set forth above, the travel speed of a small diameter ink drop is less than that of a large diameter ink drop. Consequently, as shown in FIG. 19(*b*), a small diameter ink drop experiences a shift in position in a direction opposite the direction of scanning D3.

Moreover, in actual printing, the different ink drop travel speeds may cause a large diameter ink dot and a small diameter ink dot to overlap in an image having, for example, a gradation level 5, which causes said image to be undesirably lighter than an image having a gradation level 4.

FIG. 20 further illustrates the deterioration of image quality due to dot deformation. Because the travel speed of a small diameter ink drop is less than that of a large diameter ink drop, part of a small diameter printed ink dot may merge with an adjacent large diameter printed ink dot. The result is a gourd-shaped dot. Understandably, if a number of such gourd-shaped dots are printed, the printed image will have poor granularity and appear rough.

FIG. 21 also illustrates the deterioration in image quality when a cyclical pattern is printed. Where lines of small diameter printed ink dots and lines of large diameter printed ink dots are alternately printed, the small diameter ink dots are formed closer to the large diameter dots than desired. This occurrence is obvious given that the travel speed of the small diameter ink drops is less than that of the large diameter ink drops. Consequently, the distances between lines will not be constant and the printed image will have cyclical noise.

The problem and examples described above arise from the differing travel speeds of ink drops having different sizes. At least one technique to equalize different travel speeds using an air flow is well known.

FIG. 22 illustrates both the structure and technique utilizing air flow to equalize ink drop travel so as to establish a constant travel speed. The area that expels an ink drop includes piezoelectric element 201, ink channel 202, nozzle 203, and air flow path 204. Piezoelectric element 201, which is distorted via the application of a pulse voltage, causes the pressurization of ink inside ink channel 202. The ink thus pressurized is discharged through nozzle 203 as ink drop 205. The travel speed of ink drop 205 may be made constant by blowing air into air flow path 204, located in front of nozzle 203, in the manner shown by arrow 206.

While this technique has shown an ability to equalize different ink drop travel speeds, printing devices which incorporate this system are complex, which leads to an increase in the cost of manufacture.

SUMMARY OF THE INVENTION

The present invention is directed to overcoming the shortcomings of the present art. The present invention is drawn to an inkjet printing apparatus for forming an image on a printing medium. The inkjet printing apparatus includes a print head, to discharge ink drops to form an image in accordance with image data, and a controller. The controller, drives the print head in a first scanning direction to discharge first ink drops having a first travel speed and also drives the print head in a second scanning direction to discharge second ink drops having a second travel speed.

In another manner, the inkjet printing apparatus of the present invention includes a print head, for the purposes set forth above, and a controller to effect the print head to (i) discharge ink drops in a first scanning direction to form printed ink dots of a first diameter and (ii) discharge ink drops in a second scanning direction to form printed ink dots of at least a second diameter.

An object of the present invention is to provide an inkjet printing device that can maintain good image quality using a simple construction.

Another object of the present invention is to prevent printing irregularities associated with the discharging of ink drops having different traveling speeds.

Another object of at least one embodiment of the present invention is to utilize the natural scanning motion of a print head to avoid printing irregularities associated with the discharge of ink drops which form printed ink dots of variable diameters.

Other objects and advantages of the present invention will be apparent to those of ordinary skill in the art having reference to the following specification together with the drawings.

BRIEF DESCRIPTION OF THE DRAWINGS

Referring now to the drawings in which like reference numerals and letters indicate corresponding elements throughout the several views, if applicable:

FIG. 1 is a perspective view of an inkjet printer according to an embodiment of the present invention;

FIG. 2 is a plan view illustrating a print head of the present invention;

DETAILED DESCRIPTION OF THE PREFERRED EMBODIMENTS

Figure 3:
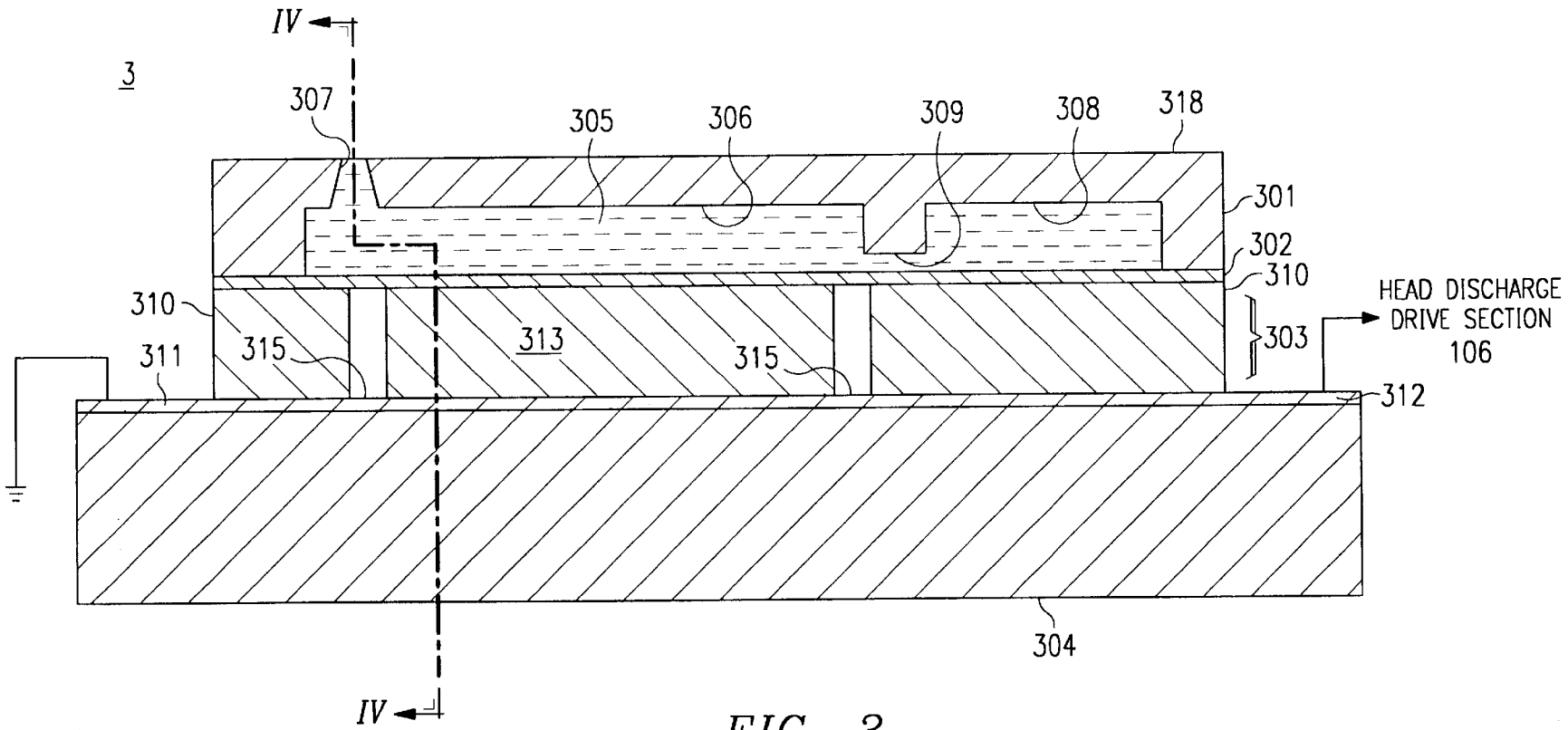
FIG. 3 is a sectional view taken along line III—III of the print head of FIG. 2.

An inkjet printer according to an embodiment of the present invention will be described below with reference to the drawings.

FIG. 1 is a perspective view schematically showing the construction of an inkjet printer 1 according to an embodiment of the present invention. The inkjet printer 1 includes an inkjet type print head 3; a carriage 4 for holding the print head 3; shafts 5 and 6 for reciprocating the carriage 4 in parallel with a printing surface of a print medium 2; a driving motor 7 for reciprocating the carriage 4 along the shafts 5 and 6; a timing belt 9 for transforming the rotation of the driving motor 7 into a reciprocating motion of the carriage 4; and an idling pulley 8. The inkjet printer 1 accommodates a print medium 2, or a print sheet, wherein a print sheet 2 may be a paper sheet (for example, Superfine™ paper, Epson Corporation), a thin, plastic sheet or film, or the like.

The carriage 4 is reciprocated by a combination of the driving motor 7, the idling pulley 8, and the timing belt 9 in the directions D1 and D2, wherein the print head 3 mounted thereto successively prints images one line at a time. Every time the printing of one line is completed, the print sheet 2 is fed in its lengthwise direction to allow printing of a next line and to generate an image on the print sheet 2.

The inkjet printer 1 further includes a platen 10 which concurrently serves as a guide plate for guiding the print sheet 2 along a transfer path; a sheet pressing plate 11 for pressing the print sheet 2 against the platen 10 to prevent lifting; a discharging roller 12 for discharging the print sheet 2; a spur roller 13; a recovering system 14 for recovering a defective ink discharge of the print head 3; and a paper feeding knob 15 for manually feeding the print sheet 2.

A print sheet 2 is fed either manually or by a paper feeding unit (not shown), such as a cut sheet feeder, into a printing section where the print head 3 and the platen face each other. In this stage, the amount of rotation of a paper feeding roller (not shown) controls the feeding of the print sheet 2 into the printing section.

Figure 4:
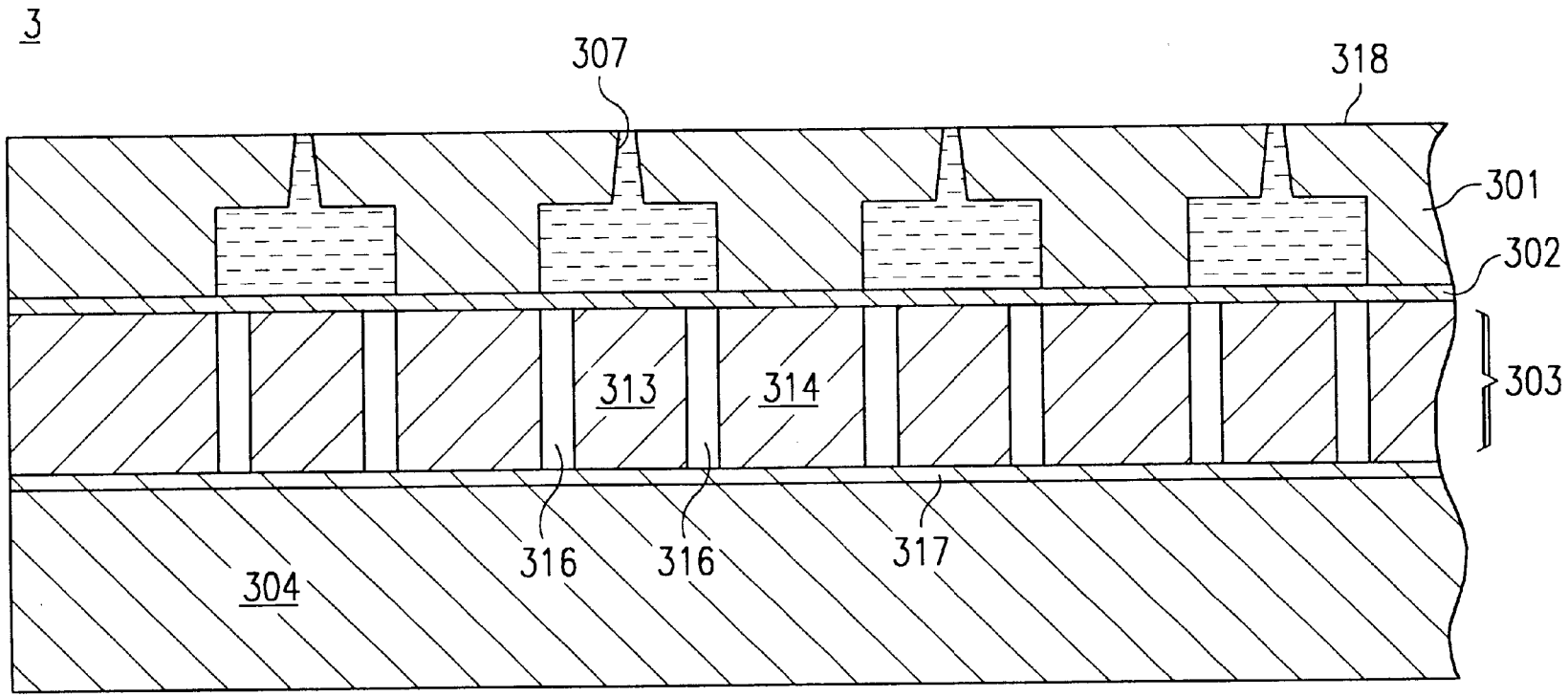
FIG. 4 is a sectional view taken along line IV—IV of the print head of FIG. 3.

The print head 3 of the inkjet printer 1 and its periphery will be described next with reference to FIGS. 2 through 5. FIGS. 2, 3, and 4 illustrate the print head 3 of the present invention. Specifically, FIG. 2 is a plan view of the print head 3, FIG. 3 is a section view taken along the line III—III of the print head 3 of FIG. 2, and FIG. 4 is a section view taken along the line IV—IV of the print head 3 of FIG. 3.

Referring to FIG. 3, the print head 3 is constructed of a nozzle plate 301, a membrane 302, a piezoelectric member 303, and a base plate 304 in an integrally stacked configuration.

The nozzle plate 301 is constructed of metal, synthetic resin, ceramic, or alike material. A surface 308 of nozzle plate 301, which faces membrane 302, is finely finished by electroforming, photolithography or the like, so that a plurality of recesses are formed. These recessions establish a plurality of ink channels 306 for storing ink 305; an ink supplying chamber 308 that contains resupply ink 305; and ink inlets 309 that connect ink channels 306 to ink supplying chamber 308. This finished surface 308 is further provided with an ink repellent layer, for example, a Teflon® coating (DuPont Corp., Wilmington, Del.).

The ink channels 306 are elongated in a lateral direction with respect to print head 3 and are arranged in parallel in a direction perpendicular to such lateral direction. The ink supplying chamber 308, positioned tone side of the ink channels 306, is in fluid communication with an ink tank (not shown) and operates to supply ink 305 from the ink tank to ink channels 306. Extending from an outer surface of print head 3 to ink channels 306, nozzles 307 are positioned at an end of the ink channels 306 opposite the ink supply chamber 308. In at least one embodiment, nozzles 307 are convergently tapered, where the ink channel-side diameter is wider than the exit diameter.

In a preferred embodiment, ink 305 is a composition including 77.0% water, 6.5% diethylene glycol (DEG), 6.5% triethylene glycol monobutyl ether (TGB), 4.5% thickener (PEG #400) as a solvent, 4.5% pigment (Bayer's BK-SP) as a coloring agent, and 0.8% surfactant (Olfine E1010) and 0.2% pH adjusting agent ($NaHCO_3$) as additives.

Returning to the construction of the print head 3, membrane 302 is formed of a thin film material and is fixed between the nozzle plate 301 and the piezoelectric member 303. As a specific portion of the piezoelectric member 303 corresponds to each ink channel 306 and such portions are made to deform for the purpose of discharging an ink drop from such ink channels 306 (as will be discussed in greater detail below), the membrane 302 does not prevent the deformation of the piezoelectric member 303 portions but rather yields so as to transmit such deformation to ink channels 306.

The piezoelectric member 303 of the present invention is formed from a piezoelectric element (PZT), wherein the piezoelectric member 303 serves as an energy source for discharging ink 305 from the print head 3. Generally, a voltage is applied to a specific portion of the piezoelectric member 303, resulting in a distortion of such portion. Each piezoelectric member 303 portion corresponds to an ink channel 306. Accordingly, the distortion of a piezoelectric member 303 portion effects a change in volume in its corresponding ink channel 306 containing ink 305. By such change in volume, ink 305 is discharged through a nozzle 307.

The piezoelectric member 303 is fixed between the membrane 302 and the base plate 304. A conductive adhesive is used to join at least the piezoelectric member 303 and the base plate 304, wherein the piezoelectric member 303 is joined to the base plate 304 with respect to a wiring section 317. Prior to the membrane 302 being fixed in place, the piezoelectric member 303 is cut longitudinally and laterally in a dicing process, producing a series of longitudinal grooves 315 and lateral grooves 316. Consequently, the piezoelectric member 303 is separated into piezoelectric elements 313 corresponding to each ink channel 306; partition walls 314 positioned between adjacent piezoelectric members 313; and peripheral walls 310 which encloses these members.

On a surface of the base plate 306 which faces the piezoelectric member 303, a wiring section 317 is provided having a common electrode section 311 and an individual electrode section 312. The common electrode section 311 is electrically coupled to ground and each of the piezoelectric members 313, and the individual electrode section 312 is electrically coupled to head expulsion drive unit (FIG. 5) and to each of the piezoelectric members 313.

Figure 5:
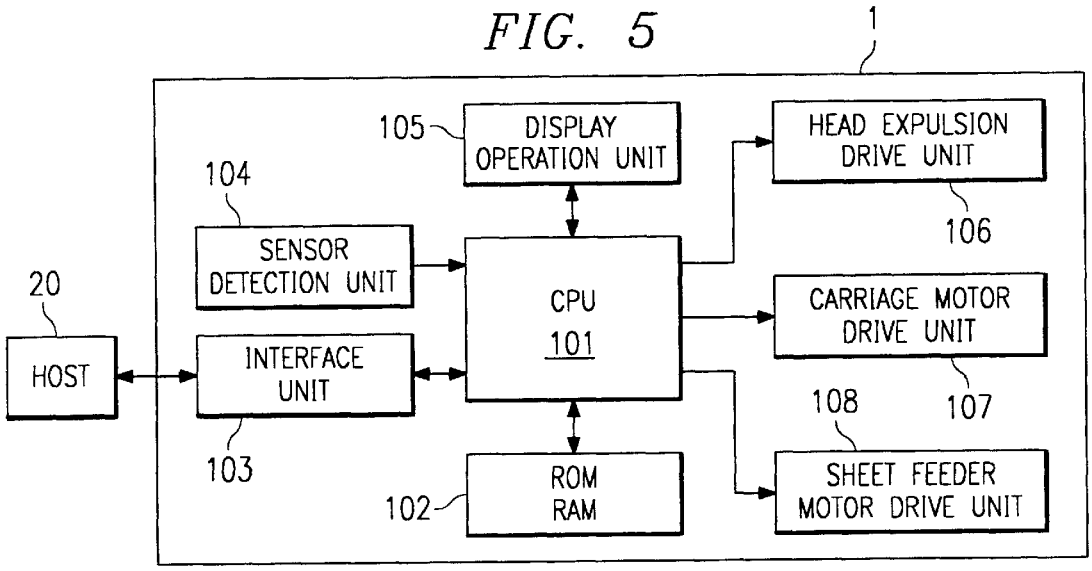
FIG. 5 is a block diagram of a control system of the inkjet printer of the present invention.

FIG. 5 is a block diagram of a control system of the inkjet printer 1 of the present invention.

Central processing unit (CPU) 101 of the control unit of inkjet printer 1 is connected to memory unit 102, interface unit 103, sensor detection unit 104, display operation unit 105, head expulsion drive unit 106, carriage motor drive unit 107, and sheet feeder motor drive unit 108. CPU 101 controls print head 3, carriage motor 7, and the sheet feeder motor by means of head expulsion drive unit 106, carriage motor drive unit 107, and sheet feeder motor drive unit 108, respectively, to effect the printing of an image on a print sheet 2.

Memory unit 102 includes a ROM (read-only memory) and RAM (random access memory). The ROM of memory unit 102 houses control programs to control inkjet printer 1 and also includes a character generator. The RAM of memory unit 102 includes a receiving buffer (not shown), that temporarily stores data transmitted from host 20, as well as a print buffer (not shown), that temporarily stores data that is to be actually printed and which is generated from the expansion of the received data. The RAM of memory unit 102 is also used as a work area when the control programs are executed.

Interface unit 103 is connected to host 20, which is a computer, word processor or the like, such that data can be transmitted and received. Sensor detection unit 104 includes sensors necessary to detect the position of the carriage 4, the temperature, the existence of a printing sheet and so on. Display operation unit 105 includes a display lamp and various operational switches.

Carriage control and printing performed by the inkjet printer 1 described above are explained below in the forms of first through fourth embodiments. Carriage control and printing are explained for the first embodiment in reference to FIGS. 6 through 12(*a*)–12(*c*), and carriage control and printing for the second through fourth embodiments are explained with reference to FIGS. 13 through 18(*a*)–18(*c*).

First, carriage control and printing for the first embodiment will be explained with reference to FIGS. 6 through 12.

Figure 6:
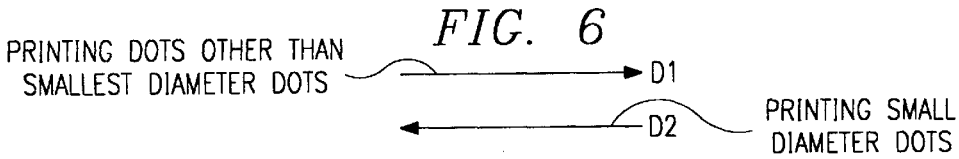
FIG. 6 illustrates a first embodiment of carriage control for printing in accordance with the present invention.

FIG. 6 illustrates the carriage control for ink dot printing for a first embodiment of the present invention. More particularly, the inkjet printer 1 of this embodiment prints ink dots, other than those ink dots having a smallest diameter, while carriage 4 moves in a forward direction (direction D1 in FIG. 1). Inkjet printer 1 prints ink dots having the smallest diameter only while carriage 4 moves in an opposite direction (direction D2 in FIG. 1). Such carriage control and printing are achieved by means of CPU 101 performing the control shown in FIG. 7.

Figure 7:
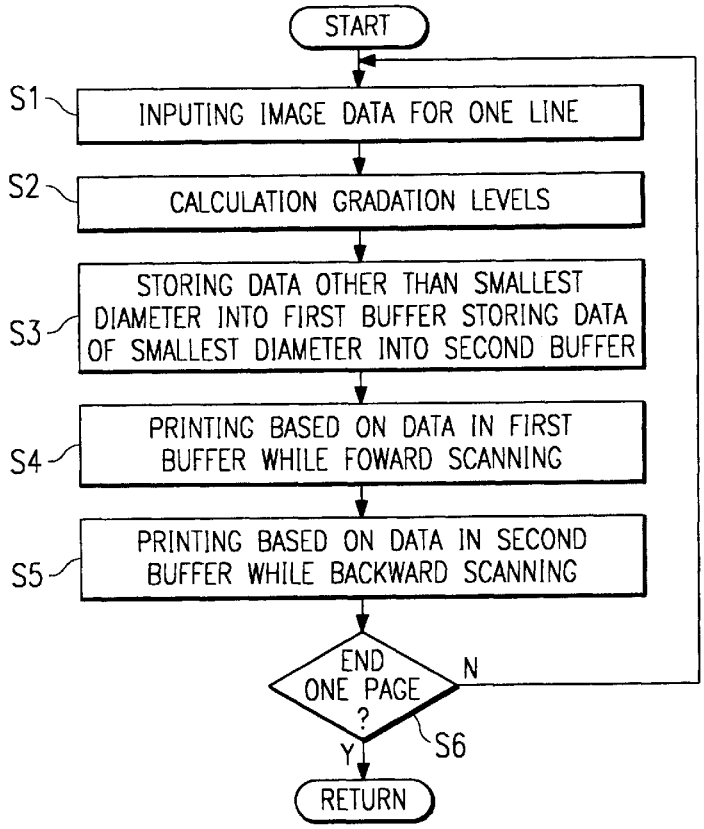
FIG. 7 is a flow chart of a control sequence for the control system of the present invention.

FIG. 7 is a flowchart to explain the control sequence of CPU 101. More specifically, the flowchart of FIG. 7 serves to execute carriage control in accordance with FIG. 6.

Referring to both FIG. 5 and FIG. 7, when executing a print operation, first, CPU 101 passes image data for one print line from host 20 to the RAM of memory unit 102 (via interface unit 103), as shown in step S1. Then, in step S2, as a part of processing the image data, as input in step S1, into data to be actually printed, CPU 101 calculates the gradation level that corresponds to each piece of image data.

In step S3, CPU 101 allocates to a first buffer (not shown) of the RAM of memory unit 102 items of print data having a gradation level using ink dot diameters other than a smallest diameter. The print data allocated and stored in the first buffer is for printing in a forward (D1; FIG. 6) direction. CPU 101 further allocates print data having a gradation level using ink dots of the smallest diameter to a second buffer (not shown) of the RAM of memory unit 102. The print data allocated and stored in the second buffer is for printing in a backward (D2; FIG. 6) direction.

In step S4, CPU 101 effects forward scanning of carriage 4 while discharging ink drops in accordance with the print data stored in the first buffer. In step S5, CPU 101 effects backward scanning of carriage 4 while discharging ink drops in accordance with the print data stored in the second buffer.

It is then determined in step S6 whether or not a page has been printed on print sheet 2. If an image for one page has not been printed (NO in step S6), CPU 101 returns to step S1. If an image for one page has been printed (YES in step S6), this routine comes to an end, whereupon CPU 101 returns to the main routine to perform other control operations.

The image data stored in the first and second buffers define particular pulse voltages, as will be discussed in greater detail below, which are applied to print head piezoelectric elements to cause the discharge of ink drops.

Figure 8:
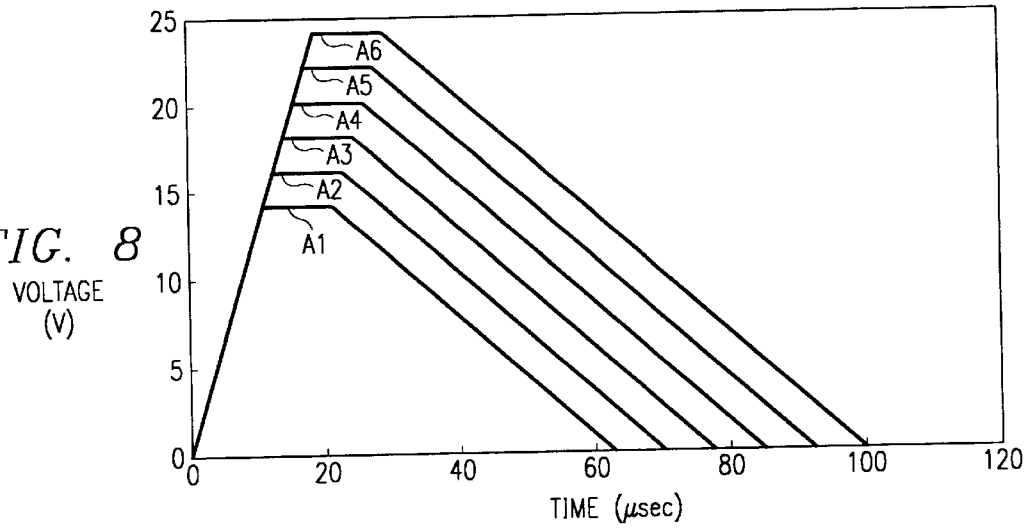
FIG. 8 illustrates a group of pulse voltage waveforms A1–A6 for application to the piezoelectric elements of the print head of the present invention.

FIG. 8 shows a group of pulse voltage waveforms output from head expulsion drive unit 106 (FIG. 5) to effect the discharge of ink. The pulse voltages are shown together on a coordinate system in which the vertical axis represents the voltage and the horizontal axis represents the time that has elapsed since the commencement of voltage application. The voltages are numbered as waveforms A1–A6, based on different pulse amplitudes. As a reference, the waveform A1, having the smallest pulse amplitude, produces the smallest diameter ink dot of waveforms A1–A6. Accordingly, waveforms A2–A6 correspond to ink dots other than the smallest diameter ink dot. Waveforms A1–A6 are capable of producing six gradations.

Figure 9:
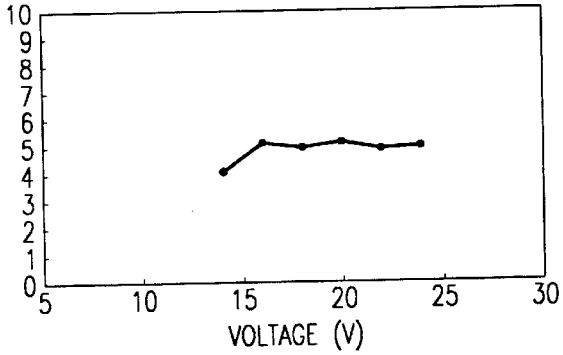
FIG. 9 illustrates ink drop travel speeds discharged from a print head of the present invention in accordance with the pulse voltages of FIG. 8.
Figure 10:
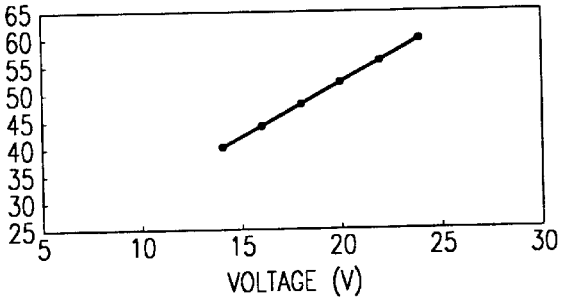
FIG. 10 illustrates ink drop volumes discharged from a print head of the present invention in accordance with the pulse voltages of FIG. 8.
Figure 11:
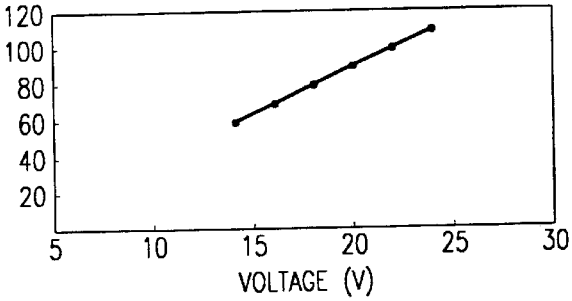
FIG. 11 illustrates printed ink dot diameters from ink drops discharged from a print head of the present invention in accordance with the pulse voltages of FIG. 8.

FIGS. 9–11 present information regarding ink drop travel speed, ink drop volume, and printed ink dot diameter for ink drops formed in accordance with the present invention and discharged in accordance with waveforms A1–A6. The travel speeds, drop volumes, and dot diameters shown in these figures represent average values obtained from the printing of 100 dots.

FIG. 9 shows the travel speed of ink drops discharged in accordance with the pulse voltages of FIG. 8. FIG. 10 shows the volume of ink drops discharged in accordance with pulse voltages of FIG. 8. FIG. 11 shows the printed diameter of ink dots formed from ink drops discharged in accordance with the pulse voltages in FIG. 8. In these figures, the horizontal axis represents the pulse amplitude of the waveforms shown in FIG. 8, while the vertical axes of FIGS. 9–11 respectively represent the travel speed, drop volume, and printed dot diameter for each different level of pulse amplitude.

Referring to FIG. 9, the travel speed of an ink drop stays essentially constant at 5 m/s for waveforms A2 through A6. In contrast, the travel speed of an ink drop for waveform A1 is 4 m/s, which is approximately 20% less than the travel speed of an ink drop for waveforms A2 through A6. Moreover, as shown in FIGS. 10 and 11, as the pulse amplitude (pulse voltage intensity) of waveforms A1–A6 increases, the discharged ink drop volume and printed ink dot diameter increase. In particular reference to FIG. 11, the approximately 60 $\mu$m diameter of printed ink dots formed in accordance with waveform A1 are necessary for creating gradations such as halftones.

It is assumed that printing takes place at 250 dpi for discharged ink drops having travel speeds consistent with the above example. The distance between the carriage 4 and the print sheet 2 is approximately 1 mm. The scan speed of the carriage is 250 mm/s. The piezoelectric element drive frequency during printing is 2.5 kHz.

As provided above, carriage 4 is moved forward (direction D1) to print ink dots produced by waveforms A2–A6. Carriage 4 is moved backward to print ink dots produced by waveform A1. When this is done, the piezoelectric elements are driven faster, such increase being as much as the difference in travel speed relative to dots having diameters other than the smallest diameter. In other words, since the travel speed for "larger" ink dots (i.e., those produced by waveforms A2–A6) is 5 m/s and the travel speed for the smallest diameter dots is 4 m/s, the difference in arrival at the printing sheet is $1/4000-1/5000=0.05$ [ms]. Therefore, the piezoelectric elements are driven such that the smallest diameter ink dots are expelled 0.05 ms sooner than those ink dots produced by waveforms A2–A6.

During printing, the absolute position of carriage 4 within the scan path is detected by means of an encoder (not shown) positioned on carriage 4. This system prevents a shift in position between the printed ink dots that are printed when the carriage 4 moves forward (direction D1) and the printed ink dots that are printed when the carriage 4 moves backward (direction D2). Incidentally, when performing printing of the smallest diameter dots corresponding to waveform A1, a 2.5 kHz piezoelectric element drive frequency may be maintained.

Using such carriage control and printing in this manner, shifts in position for small diameter ink dots during printing may be prevented and good image quality may be maintained while utilizing a simple print head construction.

Figure 12A:
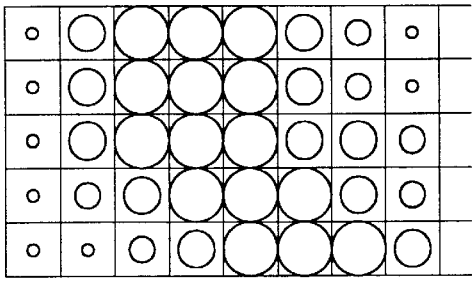
FIGS. 12(*a*)–12(*c*) illustrate an example of printed ink dots in accordance with the first and second embodiments of the present invention.
Figure 12B:
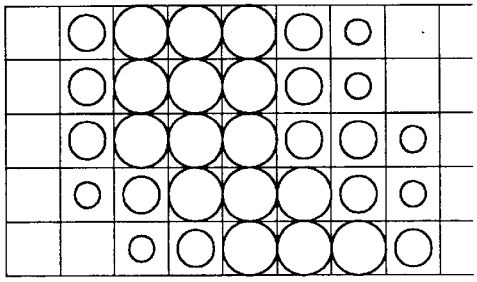
Figure 12C:
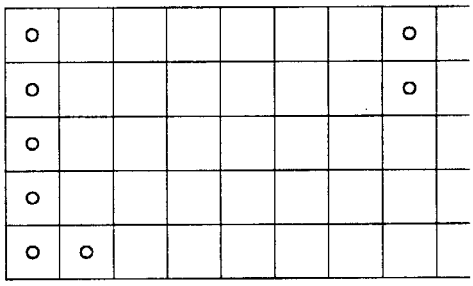

FIGS. 12(*a*)–12(*c*) illustrate ink dots printed on a print sheet 2 using the first embodiment. FIG. 12(*a*) shows printed ink dots that are printed during the forward and backward scanning of carriage 4. FIG. 12(*b*) shows printed ink dots that are printed during the forward scanning of carriage 4. FIG. 12(*c*) shows printed ink dots that are printed during the return scanning of carriage 4. Functionally, ink dots having a specified diameter or greater are printed as print head 3 moves in a forward direction (FIG. 12(*b*)) and, during a return pass by print head 3, ink dots having the smallest diameter are printed (FIG. 12(*c*)), thus producing a combined image as shown in FIG. 12(*a*).

Carriage control and printing for the second through fourth embodiments will now be explained with reference to FIGS. 13 through 18.

Figure 13A:
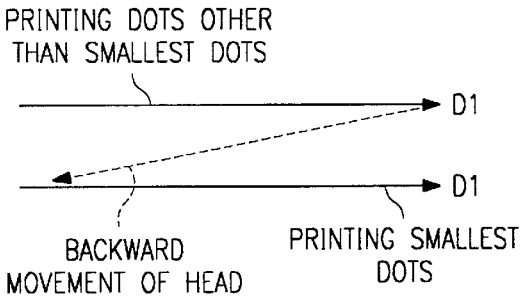
FIGS. 13(*a*)–13(*d*) illustrate a second embodiment, a third embodiment, and a fourth embodiment, respectively, of carriage control for printing in accordance with the present invention.
Figure 13B:
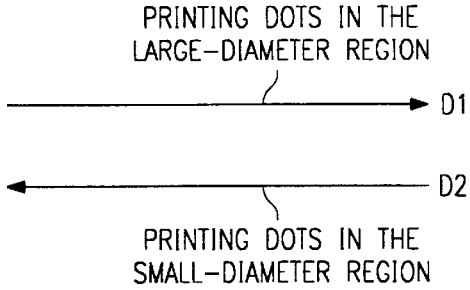
Figure 13C:
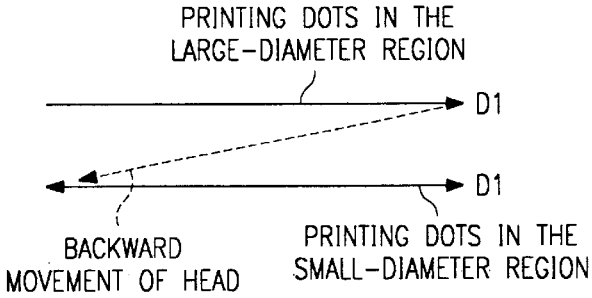

FIGS. 13(*a*), 13(*b*) and 13(*c*) correspond to the second, third, and fourth embodiments, respectively, of the present invention. In the second through fourth embodiments, the CPU 101 (FIG. 5) executes control in a manner similar to that set forth in the flowchart of FIG. 7. Differences in control are set forth in detail below.

In the second embodiment and in reference to FIG. 13(*a*), a group of ink dots having a variety of possible diameters (such group excluding a smallest diameter) are printed while carriage 4 moves in a forward scanning direction (D1). Following the carriage 4 returning to a "home" position through rearward movement (direction D2), the smallest diameter ink dots are printed as the carriage 4 again moves in the forward scanning direction (D1). At least for this example, the pulse voltages to drive the piezoelectric elements are the same as those for the first embodiment.

In the third embodiment and in reference to FIG. 13(*b*), a group of ink dots having larger diameters, i.e., a large-diameter region, are printed while carriage 4 moves in a forward direction (D1). A group of ink dots having smaller diameters, i.e., a small-diameter region, are printed while carriage 4 moves in a rearward direction (D2). The large-diameter regions and the small-diameter regions are discussed in greater detail below.

In the fourth embodiment and in reference to FIG. 13(*c*), ink dots in the large-diameter region are printed while carriage 4 moves in a forward direction (D1). Similar to the second embodiment, carriage 4 thereafter returns to a "home" position through rearward movement (direction D2), wherein ink dots in the small-diameter region are printed while carriage 4 again moves in a forward direction (D1). At least for this example, the pulse voltages to drive the piezoelectric elements are the same as those for the third embodiment.

The large-diameter and small-diameter regions, referred to in connection with the third and fourth embodiments, allow ink dots having different diameters to be divided into a group of ink dots that have relatively large diameters and a group of ink dots that have relatively small diameters, wherein, in a preferred embodiment, each group has multiple ink dot diameters possible.

Figure 14:
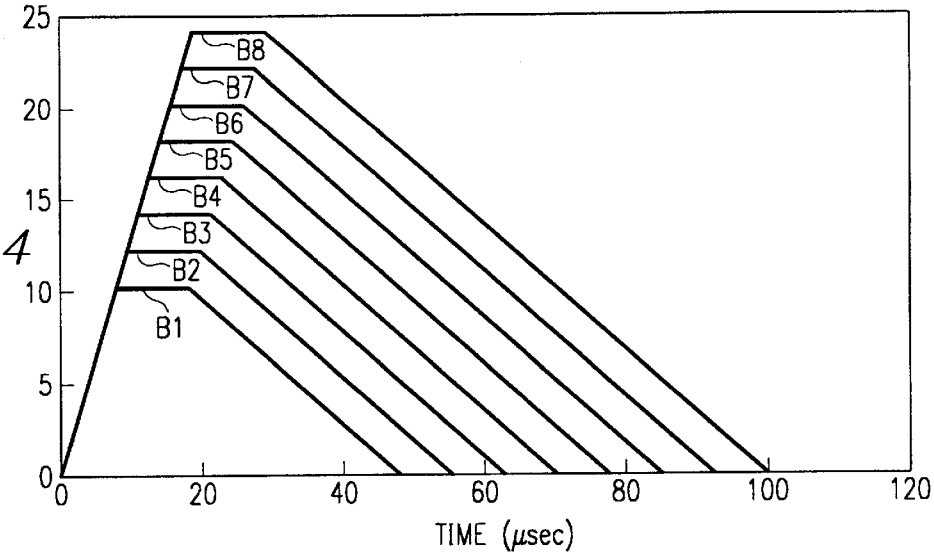
FIG. 14 illustrates a group of pulse voltage waveforms B1–B8 for application to the piezoelectric elements of the print head of the present invention in accordance with the third embodiment.

Similar to that illustrated in FIG. 8, FIG. 14 shows a second group of pulse voltage waveforms for output from head expulsion drive unit 106 (FIG. 5). The waveforms of FIG. 14 are capable of producing eight gradations. The voltages are numbered as waveforms B1–B8, based on different pulse amplitudes. As a reference, the waveform B1, having the smallest pulse amplitude, produces the smallest diameter ink dot of waveforms B1–B8. Defining the regions of waveforms B1–B8, waveforms B1 through B3 belong to a small-diameter region, and waveforms B4 through B8 belong to a large-diameter region.

Measurements identical to the measurements that were obtained for the first embodiment, the results of which were shown in FIGS. 9–11, were also conducted for the third embodiment. The results of said measurements are shown in FIGS. 15"17.

Figure 15:
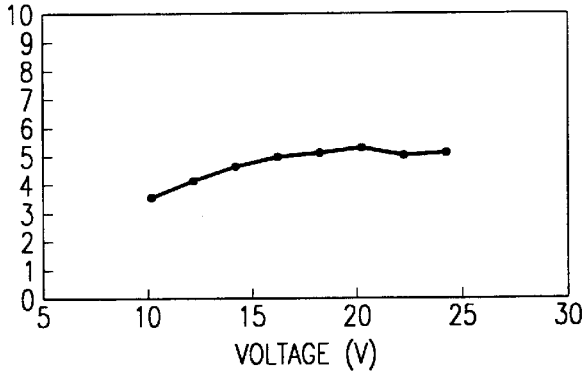
FIG. 15 illustrates ink drop travel speeds discharged from a print head of the present invention in accordance with the pulse voltages of FIG. 14.
Figure 16:
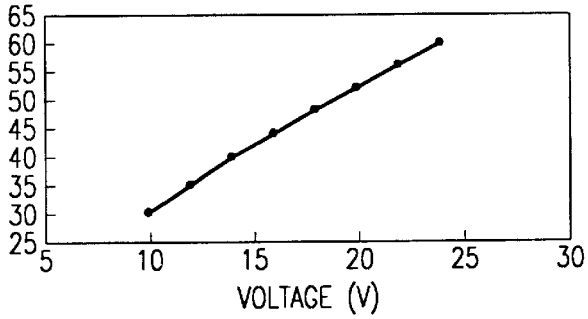
FIG. 16 illustrates ink drop volumes discharged from a print head of the present invention in accordance with the pulse voltages of FIG. 14.
Figure 17:
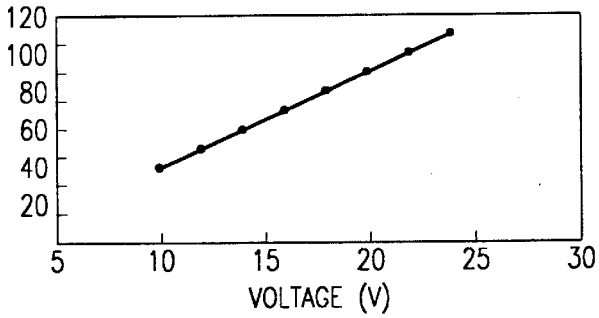
FIG. 17 illustrates printed ink dot diameters from ink drops discharged from a print head of the present invention in accordance with the pulse voltages of FIG. 14.

FIG. 15 shows the travel speed of ink drops discharged in accordance with the pulse voltages of FIG. 14. FIG. 16 shows the volume of ink drops discharged in accordance with pulse voltages of FIG. 14. FIG. 17 shows the printed diameter of ink dots formed from ink drops discharged in accordance with the pulse voltages in FIG. 14. In these figures, the horizontal axis represents the pulse amplitude of the waveforms shown in FIG. 14, while the vertical axes of FIGS. 15"17 respectively represent the travel speed, drop volume, and printed dot diameter for each different level of pulse amplitude.

Referring to FIG. 15, the travel speed of the ink drops of the large-diameter region stay essentially constant at 5 m/s for waveforms B4 through B8. In contrast, the travel speed of ink drops for waveforms B1, B2, and B3 are approximately 30%, 20%, and 10% less, respectively. As shown in FIGS. 16 and 17, as the pulse amplitude of waveforms B1–B8 increases, the discharged ink drop volume and printed ink dot diameter increase. Ink drops formed by waveforms B1–B3 create printed ink dots having approximate diameters of 40 $\mu$m, 50 $\mu$m, and 60 $\mu$m, thus enabling higher image quality than the image created in the first embodiment.

It is assumed that printing takes place at 250 dpi for discharged ink drops having travel speeds consistent with the above example. The distance between the carriage 4 and the print sheet 2 is approximately 1 mm. The scan speed of the carriage is 250 mm/s.

When the carriage 4 is moved in a forward direction (D1), printing of ink dots of the large-diameter region, corresponding to waveforms B4–B8, is performed, and the piezoelectric element drive frequency during said printing is 2.5 kHz. When the carriage 4 is moved backward (direction D2), printing of ink dots of the small-diameter region that correspond to waveforms B1–B3 is performed. During printing, the absolute position of carriage 4 within the scan path is detected by means of an encoder (not shown) positioned on carriage 4. This system prevents a shift in center positions of the printed ink dots.

Using such carriage control and printing in this manner, shifts in position for ink dots of the small-diameter region during printing may be prevented and good image quality may be maintained while utilizing a simple print head construction.

Figure 18A:
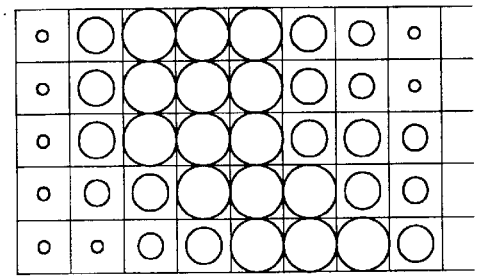
FIGS. 18(*a*)–18(*c*) illustrate an example of printed ink dots in accordance with at least the third embodiment of the present invention.
Figure 18B:
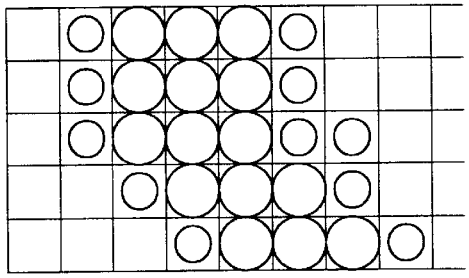
Figure 18C:
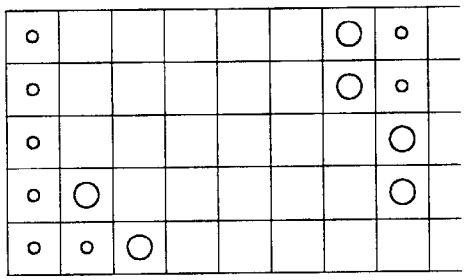
Figure 19A:
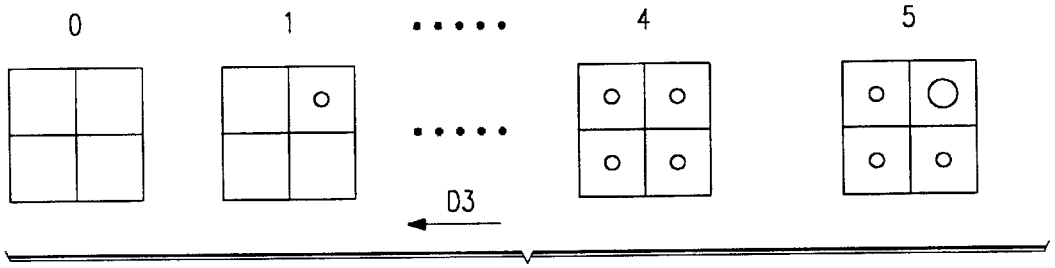
FIG. 19(a) (PRIOR ART)
FIGS. 19(*a*) and 19(*b*) illustrate image quality deterioration caused by a shift in the positions of printed ink dots when using a dither method.
Figure 19B:
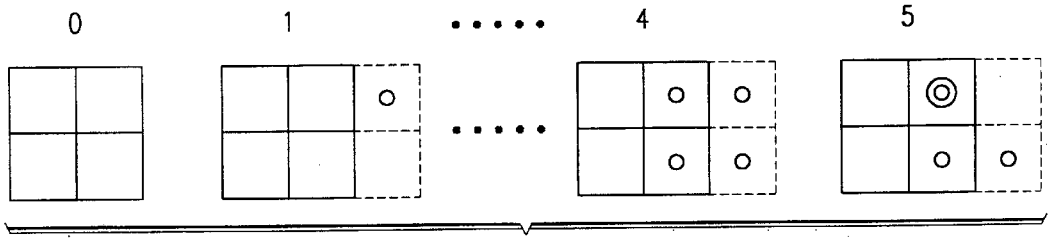
FIG. 19(b) (PRIOR ART)
Figure 20:
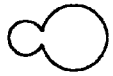
FIG. 20 (PRIOR ART)
FIG. 20 illustrates image quality deterioration caused by printed ink dot deformation.
Figure 21:
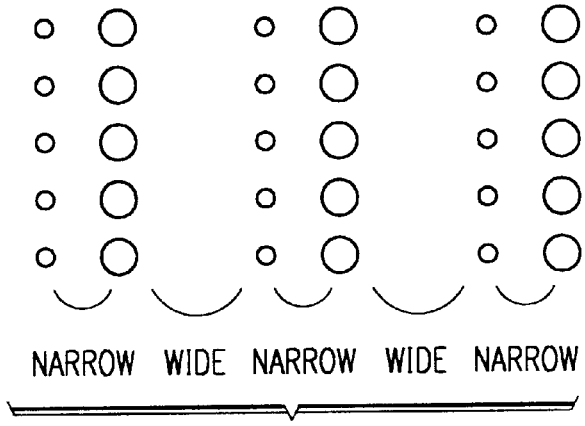
FIG. 21 (PRIOR ART)
FIG. 21 illustrates image quality deterioration when printing a cyclical pattern using a conventional inkjet print system.
Figure 22:
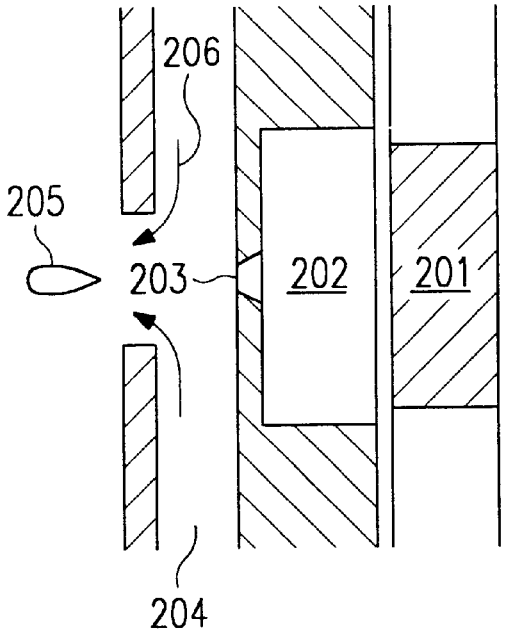
FIG. 22 (PRIOR ART)
FIG. 22 illustrates conventional technology using a forced air flow to make the travel speed of discharged ink drops equal.

FIGS. 18(*a*)–18(*c*) illustrate an example of ink dots to be printed on a print sheet 2 in accordance with at least the third embodiment. FIG. 18(*a*) shows printed ink dots that are printed during the forward and backward scanning of the carriage 4. FIG. 18(*b*) shows printed ink dots that are printed during the forward scanning of the carriage 4. FIG. 18(*c*) shows printed ink dots that are printed during the return scanning of the carriage 4. Functionally, ink dots of the large-diameter region are printed in a forward pass (FIG. 18(*b*)), and ink dots of the small-diameter region are printed in a return pass (FIG. 12(*c*)). Following the return pass, an image is formed consistent with FIG. 12(*a*).

As described above, an inkjet printer 1 in accordance with the present invention and each of the embodiments prevents ink dot positional shifts for ink dots of the small-diameter region during printing, and good image quality may be maintained while utilizing a simple print head construction.

While specific dots are printed when the carriage is moved in a specific direction in the embodiments described above, various combinations of the direction of the carriage movement and the type of printed dots are possible within the scope of the present invention. For Example, although each of the above described embodiments of the present invention discloses a inkjet head, which moves in the main scan direction (i.e., in the traverse direction of the recording sheet), this should not be construed as a limitation. A fixed inkjet head, having a width substantially equal to a width of a recording paper may also be provided where the recording sheet is fed in the vertical direction for scanning, and where the fixed inkjet head includes a plurality of nozzles disposed across the width of the recording sheet. In the inkjet printer employs such fixed type inkjet head, the inkjet head may be controlled so that the inkjet dots corresponding to the small-diameter region are formed during the feeding of the recording sheet in an advanced direction of the vertical direction, and so that the inkjet dots corresponding to the large-diameter region are formed during the feeding of the recording sheet in a reverse direction of the vertical direction. By employing this structure, the inkjet printer can form an excellent image at high speed, inasmuch as the scanning of the inkjet head in the main scan direction is not needed.

This application is based on Japanese Patent Application No.09-059262, as filed in Japan, the disclosure of which is incorporated herein by reference.

While the invention has been described herein relative to a number of particularized embodiments, it is understood that modifications of, and alternatives to, these embodiments, such modifications and alternatives realizing the advantages and benefits of this invention, will be apparent to those of ordinary skill in the art having reference to this specification and its drawings. It is contemplated that such modifications and alternatives are within the scope of this invention as subsequently claimed herein, and it is intended that the scope of the invention claimed herein be limited only by the broadest interpretation of the appended claims to which the inventors are legally entitled.

What is claimed is:

1. An inkjet printing apparatus for forming an image on a printing medium, said inkjet printing apparatus comprising:

a print head to discharge ink drops to form an image in accordance with image data; and a controller, in communication with the print head, to drive the print head in a first scanning direction to discharge first ink drops having a first travel speed and to drive the print head in a second scanning direction to discharge second ink drops having a second travel speed, wherein the first travel speed differs from the second travel speed, and wherein the first ink drops are dischargeable in a pass of the print head relative to a print area, and the second ink drops are dischargeable in another pass of the print head relative to the print area.

2. An apparatus in accordance with claim 1, wherein the first ink drops form first printed ink dots having a first diameter, and the second ink drops form second printed ink dots, each of the second printed ink dots having a diameter greater than the first diameter.

3. An apparatus in accordance with claim 1, wherein the first ink drops form first printed ink dots and the second ink drops form second printed ink dots, and each of the second printed ink dots has a diameter greater than a diameter of the first printed ink dots.

4. An apparatus in accordance with claim 1 wherein the first scanning direction is in a same direction as the second scanning direction.

5. An apparatus in accordance with claim 1, wherein the first scanning direction is in a direction opposite to the second scanning direction.

6. An inkjet printing apparatus for forming an image on a printing medium, said inkjet printing apparatus comprising:

a print head to discharge ink drops to form an image in accordance with image data; and a controller, in communication with the print head, to control the print head to discharge ink drops in a first scanning direction, to form printed ink dots of a first diameter, and to discharge ink drops in a second scanning direction, to form printed ink dots of at least a second diameter, wherein ink dot diameters corresponding to ink drops discharged in the second scanning direction differ from the first diameter, and ink drops discharged in the first scanning direction have a discharge travel speed that differs from a discharge travel speed of ink drops discharged in the second scanning direction, and wherein ink drops corresponding to the first diameter are dischargeable in a pass of the print head relative to a print area, and ink drops corresponding to at least the second diameter are dischargeable in another pass of the print head relative to the print area.

7. An apparatus in accordance with claim 6, wherein the second diameter is greater than the first diameter.

8. An apparatus in accordance with claim 6, wherein the first diameter is selected by the controller in accordance with the image data, and the first diameter is less than the second diameter.

9. An apparatus in accordance with claim 6, wherein the first scanning direction is in a same direction as the second scanning direction.

10. An apparatus in accordance with claim 6, wherein the first scanning direction is in a direction opposite to the second scanning direction.

11. A method of printing an image comprised of a plurality of printed ink dots of at least two diameters in accordance with image data with an inkjet printing apparatus having a print head, the method comprising the steps of:

driving the print head, in a first direction, to effect a pass of a print area and to cause a discharge of ink drops in accordance with image data, said ink drops forming first printed ink dots having a first diameter; and driving the print head, in a second direction, to effect another pass of the print area and to cause a discharge of ink drops in accordance with image data, said ink drops forming second printed ink dots having a second diameter, wherein the second diameter differs from the first diameter, and ink drops discharged in the first direction have a discharge travel speed that differs from a discharge travel speed of ink drops discharged in the second direction.

12. A method in accordance with claim 11, wherein the first scanning direction is in a same direction as the second scanning direction.

13. A method in accordance with claim 11, wherein the first scanning direction is in a direction opposite to the second scanning direction.

14. A method of printing an image comprised of a plurality of printed ink dots of at least two diameters in accordance with image data with an inkjet printing apparatus having a print head, the method comprising the steps of:

driving the print head, in a first direction, to effect one pass of a print area and to cause a discharge of ink drops in accordance with image data, said ink drops forming first printed ink dots having a first diameter, the first diameter being within a diameter range; and driving the print head, in a second direction, to effect another pass of the print area and to cause a discharge of ink drops in accordance with image data, said ink drops forming second printed ink dots having at least a second diameter, wherein the first diameter is less than the second diameter, and ink drops discharged in the first direction have a discharge travel speed that is greater than a discharge travel speed of ink drops discharged in the second direction.

15. A method in accordance with claim 14, wherein the first scanning direction is in a same direction as the second scanning direction.

16. A method in accordance with claim 14, wherein the first scanning direction is in a direction opposite to the second scanning direction.

17. A method of printing an image comprised of a plurality of dots of variable diameters with an inkjet printing apparatus having an inkjet print head, comprising the steps of:

driving the inkjet print head, in a first direction, to effect one pass of a print area and to cause a discharge of ink drops having a first travel speed; and driving the inkjet print head, in a second direction, to effect another pass of the print area and to cause a discharge of ink drops having a second travel speed.

18. A method in accordance with claim 17, wherein the first ink drops form first printed ink dots having a first diameter, and the second ink drops form second printed ink dots, each second printed ink dot having a diameter greater than the first diameter.

19. A method in accordance with claim 17, wherein the first ink drops form first printed ink dots and the second ink drops form second printed ink dots, and a diameter of each second printed ink dot is greater than a diameter of each first printed ink dot.

20. A method in accordance with claim 17, wherein the first scanning direction is in a same direction as the second scanning direction.

21. A method in accordance with claim 17, wherein the first scanning direction is in a direction opposite to the second scanning direction.

* * * * *

UNITED STATES PATENT AND TRADEMARK OFFICE

CERTIFICATE OF CORRECTION

PATENT NO. : 6,322,185 B1
DATED : November 27, 2001
INVENTOR(S) : Masaki Asano et al.

It is certified that error appears in the above-identified patent and that said Letters Patent is hereby corrected as shown below:

Column 4,
Line 55, delete “alike”, and insert -- a like --.

Column 9,
Line 29, delete “15”17”, and insert -- 15-17 --.
Line 38, delete “15”17”, and insert -- 15-17 --.

Column 12,
Line 22, after the second instance of “of”, insert -- first --.
Line 23, after “said”, insert -- first --.
Line 28, after “of”, insert -- second --.
Line 28, after “said”, insert -- second --.
Line 46, after the second instance of “of”, insert -- first --.
Line 50, after “of”, insert -- second --.

Signed and Sealed this

Twentieth Day of August, 2002

*Attest:*

*Attesting Officer*

JAMES E. ROGAN
*Director of the United States Patent and Trademark Office*